US008061343B2

(12) United States Patent
Kamen et al.

(10) Patent No.: US 8,061,343 B2
(45) Date of Patent: Nov. 22, 2011

(54) CONTROLLABLE LAUNCHER

(75) Inventors: Dean Kamen, Bedford, NH (US); Larry B. Gray, Merrimack, NH (US); Richard J. Lanigan, Concord, NH (US)

(73) Assignee: DEKA Products Limited Partnership, Manchester, NH (US)

( * ) Notice: Subject to any disclaimer, the term of this patent is extended or adjusted under 35 U.S.C. 154(b) by 361 days.

(21) Appl. No.: 11/255,778

(22) Filed: Oct. 21, 2005

(65) Prior Publication Data

US 2006/0086349 A1 Apr. 27, 2006

Related U.S. Application Data

(60) Provisional application No. 60/620,804, filed on Oct. 21, 2004.

(51) Int. Cl.
*F41B 11/26* (2006.01)

(52) U.S. Cl. ..... 124/71; 124/70; 472/50; 472/131

(58) Field of Classification Search ..... 89/8, 1.34, 89/1.1; 124/65, 61, 63, 1, 56, 71; 446/429; 472/50, 131
See application file for complete search history.

(56) References Cited

U.S. PATENT DOCUMENTS

| | | | | | |
|---|---|---|---|---|---|
| 562,448 | A | * | 6/1896 | Zedora et al. | 482/26 |
| 824,506 | A | | 6/1906 | Obiols | |
| 826,019 | A | | 7/1906 | Crosse | |
| 1,960,264 | A | * | 5/1934 | Heinkel | 244/63 |
| 2,467,764 | A | * | 4/1949 | Martin | 104/53 |
| 2,489,315 | A | * | 11/1949 | Paulus | 244/63 |
| 3,130,947 | A | * | 4/1964 | Franks | 244/122 AC |
| 3,442,473 | A | * | 5/1969 | Rivedal et al. | 244/122 AB |
| 3,525,490 | A | * | 8/1970 | Duncan et al. | 244/122 R |
| 3,534,929 | A | * | 10/1970 | Johansen et al. | 244/63 |
| 3,968,947 | A | * | 7/1976 | Schlegel et al. | 244/63 |
| 4,079,901 | A | * | 3/1978 | Mayhew et al. | 244/63 |
| 4,238,093 | A | * | 12/1980 | Siegel et al. | 244/63 |
| 4,431,182 | A | | 2/1984 | Reynolds | |
| 4,580,982 | A | * | 4/1986 | Ruppert | 434/30 |
| 4,678,143 | A | | 7/1987 | Griffin | 244/63 |
| 4,754,840 | A | | 7/1988 | MacDonald et al. | 182/2 |
| 4,848,520 | A | | 7/1989 | Gibel et al. | 187/9 E |
| 4,932,176 | A | | 6/1990 | Roberts et al. | 52/118 |
| 5,135,074 | A | | 8/1992 | Hornagold | 182/2 |
| 5,303,695 | A | * | 4/1994 | Shopsowitz | 124/17 |

(Continued)

FOREIGN PATENT DOCUMENTS

EP 1 298 409 4/2003

OTHER PUBLICATIONS

*Telescopic Boom Lifts*, JLG Industries, Inc. http://www.omniquip.com/Products, pp. 1-2, Jun. 7, 2006.

(Continued)

*Primary Examiner* — Benjamin P Lee
(74) *Attorney, Agent, or Firm* — Michelle Saquet Temple

(57) ABSTRACT

A controllable launcher for propelling a payload through a predictable and repeatable trajectory to a desired height. The launcher has an energy source for propelling a carriage and a piston in substantially opposing directions and a controller for controlling the trajectory of the propelled payload to enable the payload to land gently at a safe impact distance from the edge of a destination structure.

16 Claims, 7 Drawing Sheets

U.S. PATENT DOCUMENTS

| | | | | |
|---|---|---|---|---|
| 5,426,444 | A | 6/1995 | Sauter et al. | 343/883 |
| 5,628,690 | A * | 5/1997 | Spieldiener et al. | 472/131 |
| 5,632,686 | A * | 5/1997 | Checketts | 472/131 |
| 5,704,841 | A | 1/1998 | Checketts | |
| 5,769,724 | A * | 6/1998 | Wiegel | 472/49 |
| 5,813,552 | A | 9/1998 | Kaspar | 212/349 |
| 5,971,320 | A | 10/1999 | Jermyn et al. | 244/17.25 |
| 6,001,022 | A | 12/1999 | Spieldiener et al. | |
| 6,083,111 | A * | 7/2000 | Moser et al. | 472/50 |
| 6,126,550 | A * | 10/2000 | Moser et al. | 472/50 |
| 6,299,336 | B1 | 10/2001 | Hulse | 362/526 |
| 6,342,017 | B1 * | 1/2002 | Kockelman | 472/131 |
| 6,378,652 | B1 | 4/2002 | Albert | 182/69.4 |
| 6,405,114 | B1 | 6/2002 | Priestley et al. | 701/50 |
| 6,408,224 | B1 | 6/2002 | Okamoto et al. | 700/245 |
| 6,467,724 | B2 | 10/2002 | Kuenkler | 244/17.25 |
| 6,497,623 | B2 * | 12/2002 | Mirfin et al. | 472/131 |
| 6,582,105 | B1 | 6/2003 | Christensen | 362/385 |
| 6,767,115 | B2 | 7/2004 | Blackwelder | 362/385 |
| 6,840,127 | B2 | 1/2005 | Moran | 74/490.04 |
| 6,851,647 | B1 * | 2/2005 | Rosenbaum et al. | 244/63 |
| 6,906,684 | B2 | 6/2005 | Turner | 343/900 |
| 6,925,671 | B1 * | 8/2005 | Mouton | 15/104.062 |
| 7,165,745 | B2 * | 1/2007 | McGeer et al. | 244/63 |
| 7,313,881 | B1 * | 1/2008 | Gieseke et al. | 42/1.14 |
| 7,465,235 | B2 * | 12/2008 | Evans | 472/50 |
| 7,819,031 | B2 * | 10/2010 | Paskoff et al. | 73/865.3 |
| 2002/0061784 | A1 * | 5/2002 | Mirfin et al. | 472/131 |
| 2003/0121350 | A1 | 7/2003 | Hvittfeldt et al. | 74/490.01 |
| 2003/0126979 | A1 * | 7/2003 | Grosch et al. | 89/1.13 |
| 2004/0149064 | A1 | 8/2004 | Narita et al. | 74/490.03 |
| 2005/0156092 | A1 | 7/2005 | Shepherd et al. | 248/404 |
| 2005/0188744 | A1 * | 9/2005 | Camio | 73/12.01 |
| 2005/0274845 | A1 * | 12/2005 | Miller et al. | 244/49 |
| 2007/0259726 | A1 * | 11/2007 | Evans | 472/135 |

OTHER PUBLICATIONS

Haulotte Group, http://www.haulotte.com/PinguelyWeb/FO/Acueil, P'g 1, Jun. 8, 2006.

Facelift, http://www.facelift.co.uk, pp. 1-4, Jun. 7, 2006.

Aerialift, http://www.aerialift.com/abouts.htm, pp. 1-2, Jun. 7, 2006.

LPI Lift Systems, http://boom.lpi-inc.com/telescoping.html, P'g 1, Jun. 8, 2006.

*Rental Equipment Register*, http://rermag.com/news/equipment_telescopic_boom_lifts, pp. 1-3, Feb. 6, 2002.

Bil-Jax, http://www.biljax.com/Products/Described/Product38.aspx, P'g 1, Jun. 8, 2006.

Calvert, J.B., http://www.du.edu/~jcalvert/tech/machines/buckling.htm, "Buckling", pp. 1-2, Jun. 8, 2006.

* cited by examiner

Pre-Launch

Post-Launch

Set Up

Initiate Launch

Mid-Lauch

Carriage Degeneration

Carriage Return

Y=X tan 70.6°

CONTROLLABLE LAUNCHER

This application claims priority from U.S. Provisional Patent U.S. Ser. No. 60/620,804, filed Oct. 21, 2004, which is incorporated herein by reference Certain aspects of this invention were developed with U.S. Government support under Contract Nos. HR0011-04-C-0056 (awarded by the Defense Advanced Research Projects Agency) and/or W911NF-05-9-0003 (awarded by the U.S. Army RDECOM). The Government may have certain rights in the invention.

TECHNICAL FIELD

The present invention relates to the field of launchers, and, more particularly, to controllable launchers that propel payloads to a desired height.

BACKGROUND

There are many existing devices for launching payloads. "Launching," as used herein and in any appended claims, refers to increasing the gravitational potential energy associated with a payload. Some devices for launching humans as well as objects into the air are mainly for amusement purposes. Circuses have amused crowds by shooting performers out of cannons. For recreational enjoyment, certain traditional devices for launching subjects catapult subjects to experience a free-fall sensation similar to the sensation of bungee jumping or skydiving. Aircraft ejection seat technology and aircraft carrier launching systems, such as catapults, are also capable of launching payloads, however, most of these designs have unpredictable and uncontrollable trajectories and/or cannot be immediately reset and reused.

One circus-type launcher uses a tetrahedral frame with elastic cords attached to the frame and a cradle for holding a person. The cradle is retracted from a rest position to a launch position causing tension in the elastic cords. Upon release, the cradle is launched based on the tension of the elastic cords. Some of the drawbacks of these designs are: the load is not guided along a particular path and the tetrahedral frame limits the trajectory angle to about 30 degrees.

Another traditional design uses bow-shaped poles that crisscross and a trampoline mat located at the crossing point. In this launcher, the subject to be launched is placed in a hollow airtight enclosure. The subject is launched at a trajectory angle around 45 degrees. A drawback of this design is it does not provide head or neck support. Alternatively, the subject may be placed inside a hollow airtight ball. However, subjects may find the extra steps of getting into and out of the ball inconvenient.

What is therefore needed is a launcher that is controllable, and able to launch payloads through a repeatable and predictable trajectory. Furthermore, the launcher should have a substantially short recycle time thus a user can launch another payload in a relatively short time after the previous launch.

SUMMARY

We provide a controllable launching device that can launch a payload safely and with accuracy, through a predictable trajectory onto a tall structure, such as a building. This device is capable of launching a subject substantially vertically from the ground onto the roof of a building. Following a launch, the launcher may advantageously be recycled in a short time in preparation for a subsequent launch.

The controllable launcher includes a base, guide rail assembly, a carriage for carrying a payload, and an energy source to propel the carriage. The invention may further include other components such as: an alignment device to align the launcher with an edge of a structure; a horizontal measuring device to calculate the distance between the structure and launcher; a calculator to determine the required energy to launch a payload to a desired height; and leveling features to level the launcher. Furthermore, stabilizing mechanisms may be added to the base and/or guide rail assembly to keep the launcher statically stable during the launch process.

The invention may include a calculator to determine the proper energy required to launch a payload to a desired height based on the weight of the payload. Preferably, such a calculation may be automated and thus performed by a microprocessor. When the payload is a human, head and spine injuries are less likely since the acceleration forces act parallel to a person's spine.

In accordance with an embodiment of the present invention, the launcher may comprise a counterbalancing system. In this counterbalancing system, the carriage and the piston components, which may be substantially equal in weight, may be connected in a closed loop connection. Based on the weight distribution and the closed loop connection, the carriage and the piston components move comparable distances to one another in substantially opposite directions.

In accordance with another embodiment of the present invention, the launcher may comprise a deceleration mechanism to minimize excessive movements of the launcher during or after the launch of a payload. The deceleration mechanism, based on the counterbalancing system, may decelerate the carriage and the piston such that other components of the launcher may not move excessively during or after the launch of a payload.

In accordance with another embodiment of the present invention, the launcher may comprise supplemental payload propulsion devices. In this embodiment, the supplemental payload propulsion device may be coupled to the carriage to further propel the payload during the launch. Additionally, such a device may be used to produce a deceleration force to decelerate the carriage after launch. In an embodiment where the supplemental payload propulsion device produces a deceleration force, the launcher may not include certain components of the deceleration system that may be redundant.

In accordance with yet another embodiment of the present invention, the launch process of the launcher may be automated. In this embodiment, automated devices using system feed back controls may align the launcher, calculate the energy required to launch the payload to the desired height, and control the appropriate valves to launch the payload.

In accordance with further yet another embodiment of the invention, the launcher is portable, quickly recharged for reuse and has a relatively short recycle time, and may use a plurality of energy sources to propel the payload.

DETAILED DESCRIPTION

Reference will now be made in detail to various embodiments of the invention, various examples of which are illustrated in the accompanying drawings, wherein the numerals indicate corresponding elements throughout the views.

Figure 1:
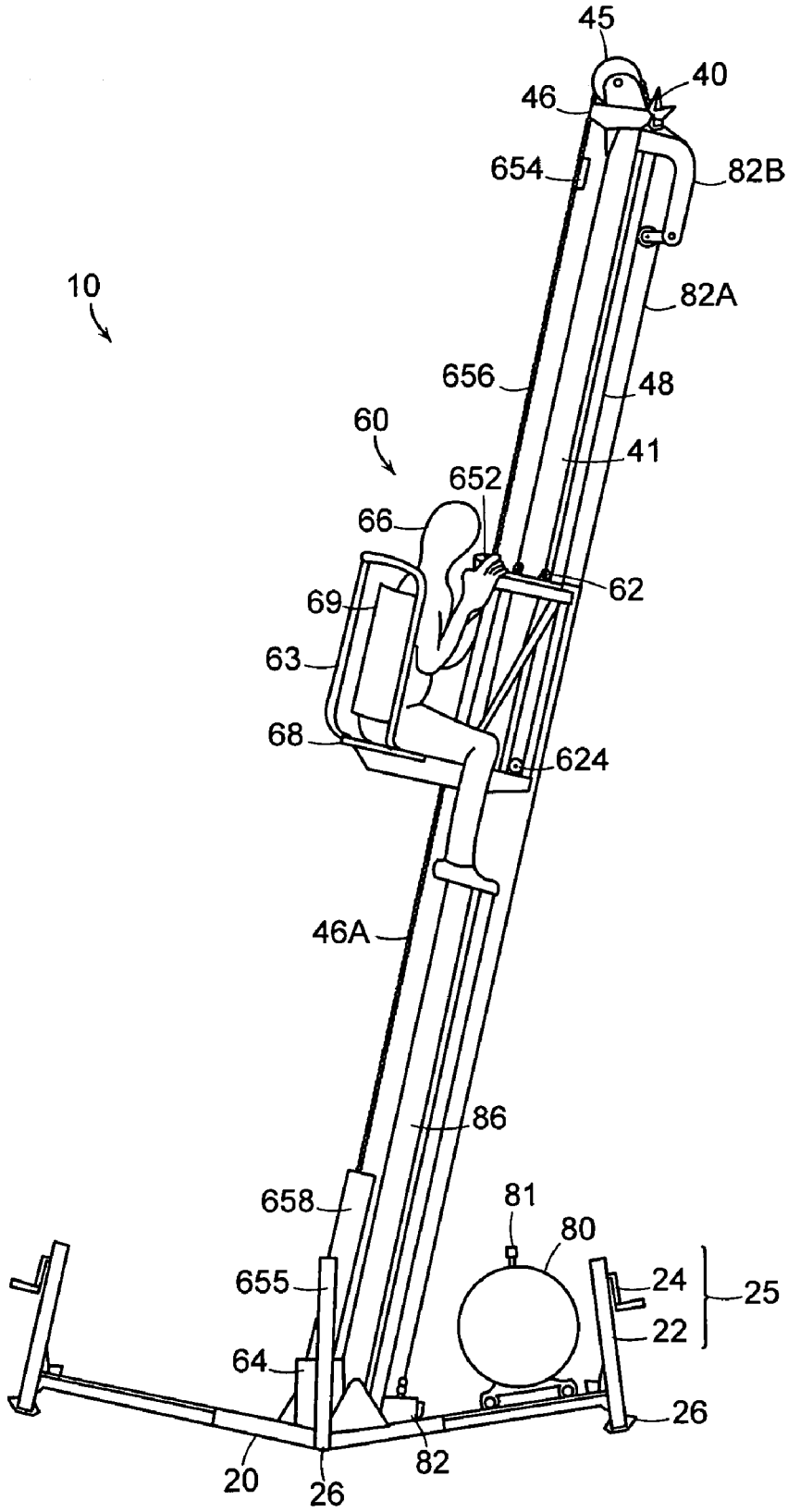
FIG. 1 is a side view of an embodiment of the controllable launcher.

As shown in FIG. 1, the controllable launcher 10 comprises a base 20, a guide rail assembly 40, a carriage 60, and an energy source 80. The launcher 10 may further comprise: leveling features 24 to level the launcher; alignment devices 49 to align the launcher with a structure; and a calculator to calculate the required energy or pressure needed to reach a desired trajectory. Structurally, the base 20 supports and stabilizes the guide rail assembly 40. On certain uneven surfaces, the base 20 may be anchored to further support or stabilize the guide rail assembly 40. The carriage 60 is coupled to the guide rail assembly 40 such that the carriage 60 can move along the guide rail 41A. An energy source 80 coupled to the base 20 and guide rail assembly 40 provides the energy to propel the carriage 60 and thus launch a payload 66. As used herein, the term "payload" may be a human, equipment, or any object.

Base

Turning now to the components of the launcher 10, as shown in FIG. 1, the base 20 positions the controllable launcher relative to a surface. The base may have positioning devices such as support posts 22 to enable it to be positioned on a surface and to provide static stability to the launcher. Still referring to FIG. 1, the support posts may be adjustable posts 22 with holes such as jacks, thus, a user may use spikes to anchor the base to a surface. Alternatively, the positioning devices 26 may include strings to enable the base to be secured to a surface. Additionally, the base may include leveling devices 24 to level the base on a surface and to ensure the proper trajectory. The leveling devices 24 may be adjustable supports with levels 25. In one embodiment, there are four leveling supports. In this embodiment, the leveling supports anchor the launcher to the surface under the forces of the launcher, and thus ensure that the launch platform is statically stable. Preferably, the anchoring devices include leveling devices such as adjustable anchoring supports with levels.

The base is constructed from materials that provide strength but are lightweight to provide sufficient structural integrity to keep the launcher and the associated mechanisms statically stable during the launch process. Steel is an example of a suitable material. Furthermore, the base may include devices to enable it to be portable and/or mobile.

Guide Rail Assembly

Figure 2A:
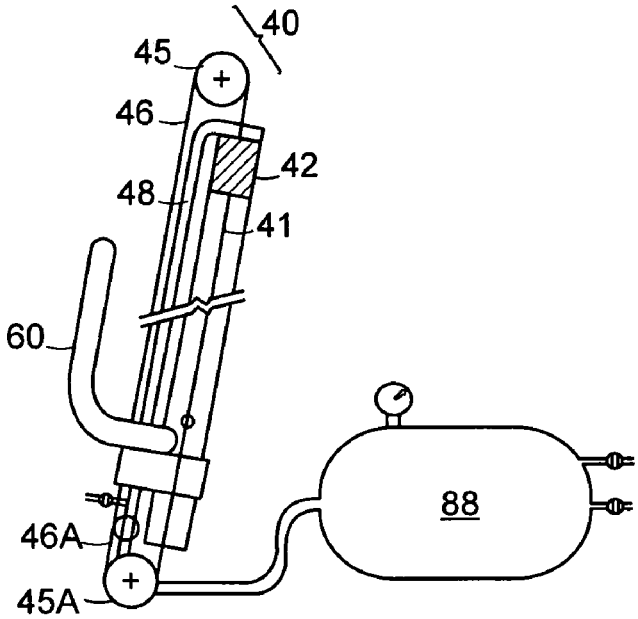
FIGS. 2A-B are schematics of the controllable launcher of FIG. 1 showing the guide rail assembly, energy source and counterbalancing system.
Figure 2B:
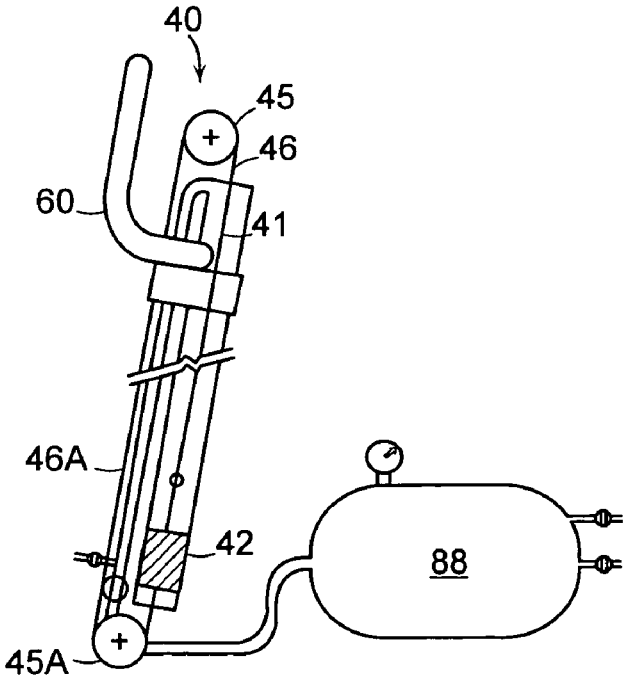

The guide rail assembly 40 as shown in FIGS. 1 and 2A-B, is coupled to and supported by the base 20. The guide rail assembly 40 may comprise a cylinder 41, guide rail pulleys 45, 45A, and an energy source feed tube 48. Cylinder 41 may be referred to herein, without limiting intent, as a "rodless cylinder", in that, in preferred embodiments, a piston 42 translates within the cylinder and is not coupled by means of any rod extending beyond the confines of the cylinder. In preferred embodiments of the invention, the exterior 41A of the rodless cylinder 41 serves as a guide rail for guiding the carriage 60 during the launch. The length of the guide rail may be sized based on a preferred acceleration of the carriage. In embodiments where acceleration occurs over the entire length of the guide rail and where the carriage 60 is used to launch human subjects, the length of the guide rails 41A may be sized to allow the carriage accelerations to stay within the guidelines established by the National Aeronautics and Space Agency (NASA). In one embodiment, the guide rails 41A are 12 feet long to limit the acceleration of the carriage 60 to approximately about 5 Gs for a 50-foot high trajectory.

In another embodiment, the rodless cylinder 41 may be a pneumatic cylinder. Here, the cylinder 41 contains a piston 42 that is attached to the carriage 60 with a cable 46. The cable 46 connecting the piston 42 and the carriage 60 connect over the top guide rail pulley 45 and under lower pulley 45A, to form a closed loop. This closed loop connection is part of the counterbalancing system. Accordingly, when the piston 42 travels downward, the carriage 60 is propelled upward. In other words, the connection is such that when the piston 42 travels downward from its starting position, as shown in the FIGS. 2A and B, the carriage 60 is pulled upward by the cable 46. The specific configuration of the closed loop connection is: a cable 46 connected to the piston 42, is routed through a seal at the top end of the cylinder 41, over a top pulley 45 and then connects to the top of the carriage 60; a second cable 46A connected to the base of the piston 42, is routed down through the bottom of the cylinder 60, around a bottom pulley 45A and then up to the top of the carriage 60.

Alignment Device

Figure 6:
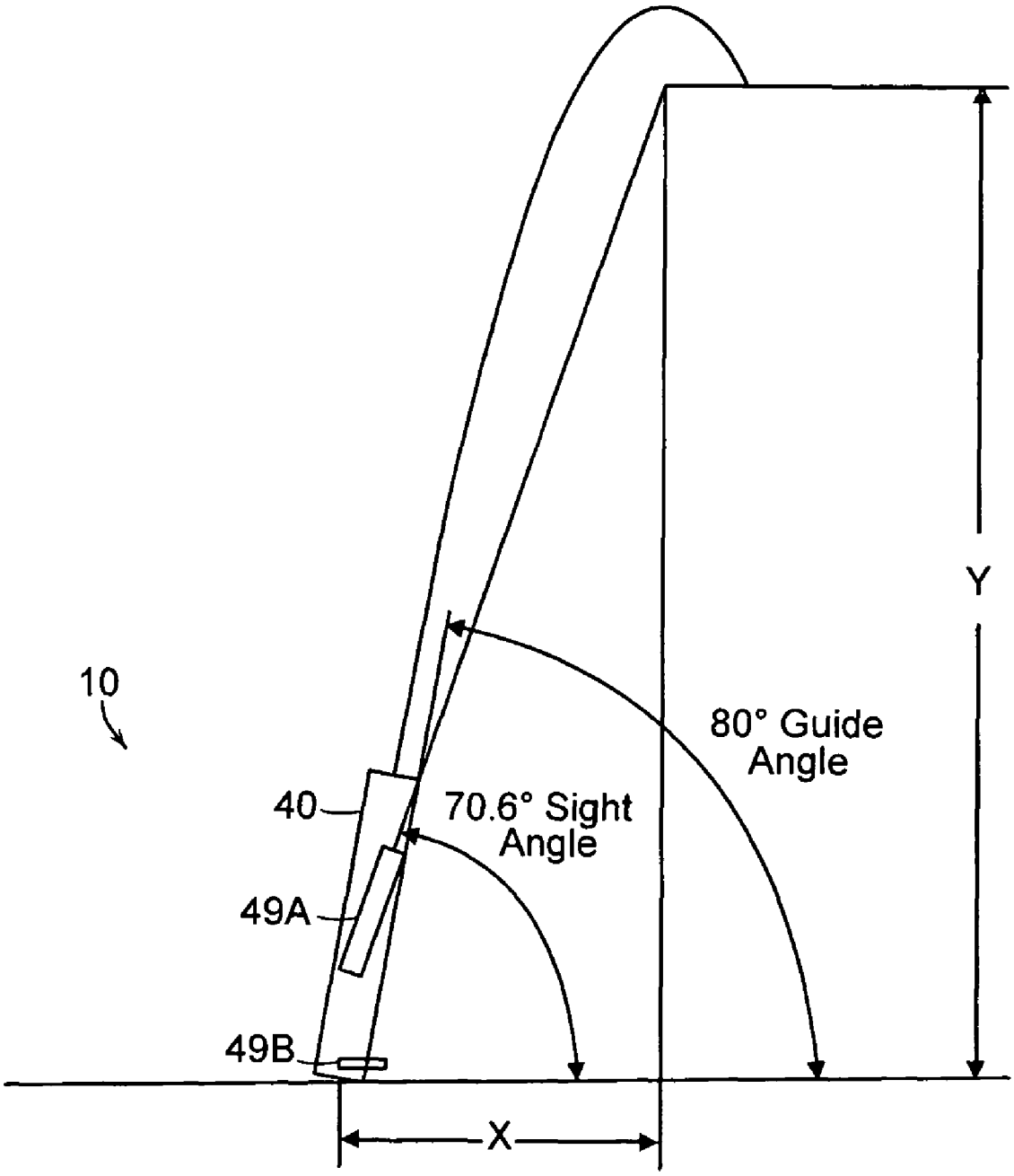
FIG. 6 shows how the alignment devices of the present invention may align the launcher with the top of the destination structure and to sight the edge of the destination structure.

The guide rail assembly 40 may further comprise alignment devices 49. The alignment devices 49 may be rigidly attached to the guide rail assembly 40. As shown in FIG. 6, the alignment devices may include an alignment scope 49A and a horizontal distance calculator 49B. The alignment scope 49A may be used to sight the leading edge of the structure above which the payload is to be launched. Similarly, the horizontal distance calculator 49B may be used to calculate the minimum horizontal distance from a structure onto which the payload is to be launched. Preferably, the alignment devices 49 are coupled to the guide rail assembly 40. Alternatively, other components of the alignment devices may be coupled to other parts of the launcher.

Carriage

Figure 3A:
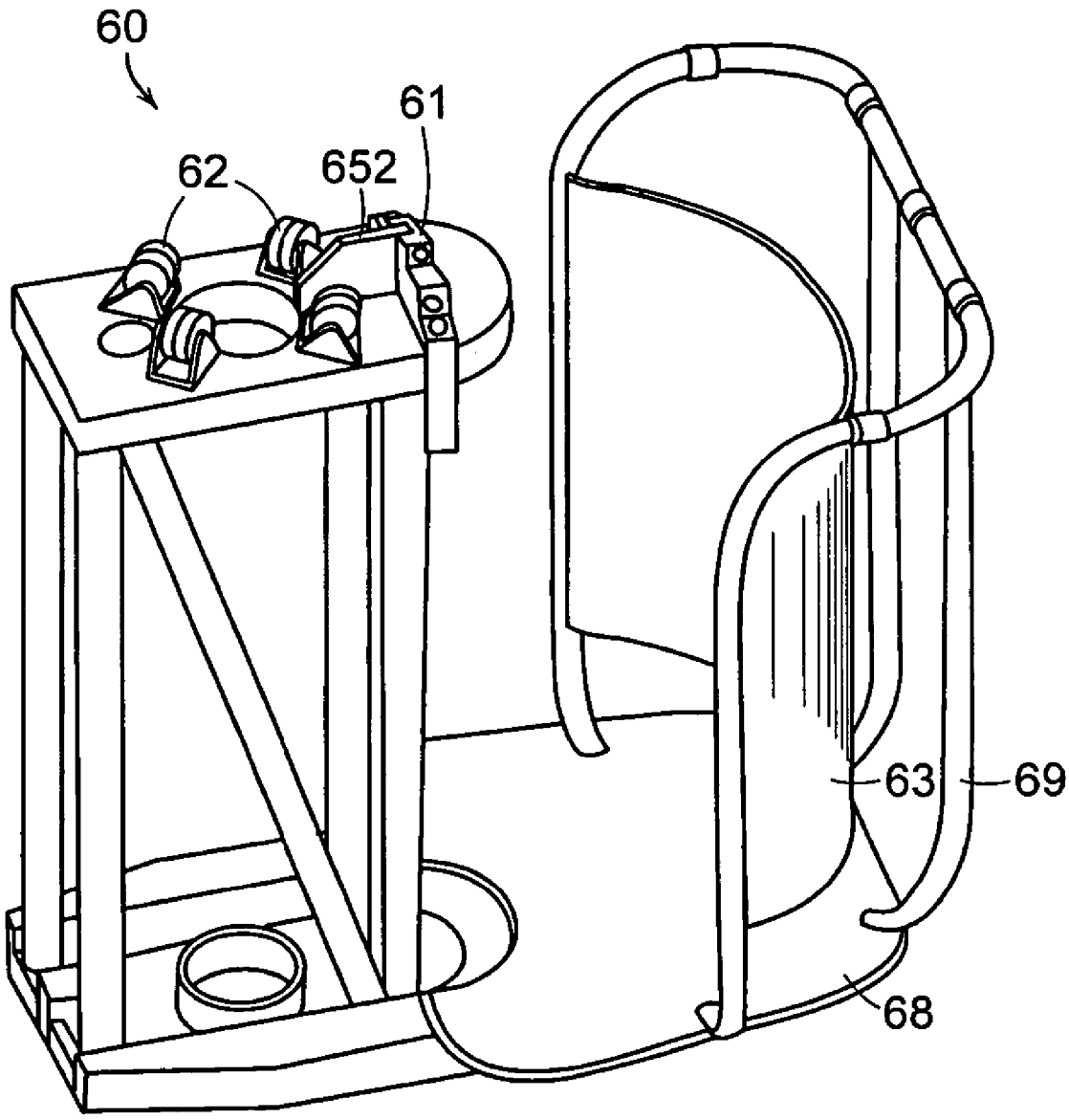
FIG. 3A is a pictorial view of an embodiment of the carriage of the controllable launcher shown in FIG. 1.

The carriage 60 as shown in FIGS. 1 and 3A, can carry the payload for launch. The carriage 60 has at least a guide wheel 62 that rides on the exterior of the rodless cylinder 41. The carriage 60 may include additional guide wheels 62A that run on other surfaces to prevent the carriage 60 from rotating during launch.

In an embodiment as shown in FIG. 3A, where the launcher may launch human subjects, the carriage is a lightweight structure designed to withstand the reaction forces of at least a 250 lbs payload accelerating at 5 Gs in addition to the force of gravity. Preferably, the carriage 60 is made of aluminum. In this embodiment, the carriage 60 includes a seat 68 and a back support 69 such that the human payload 66 may sit in the upright position and thus the acceleration forces act parallel to the subject's spine. Furthermore, the carriage 60 may be configured to secure a human subject in a standing or sitting position. The carriage 60 may further include protective shrouds that would keep human subject's body parts inside the structure of the carriage. The shrouds may further prevent objects from being caught in the carriage structure when it stops at the end of travel.

At the top of the carriage 60 is a structure 61 that is attached to a first cable 46 that in is turn attached to the piston 42. As described earlier, this structure 61 connects the carriage 60 to the piston 42 to form the closed loop connection and the carriage-piston counterbalancing system. Based on the counterbalancing system, when the piston 42 travels downward from its resting position, the carriage 60 is pulled upward by the cables 46.

Figure 3C:
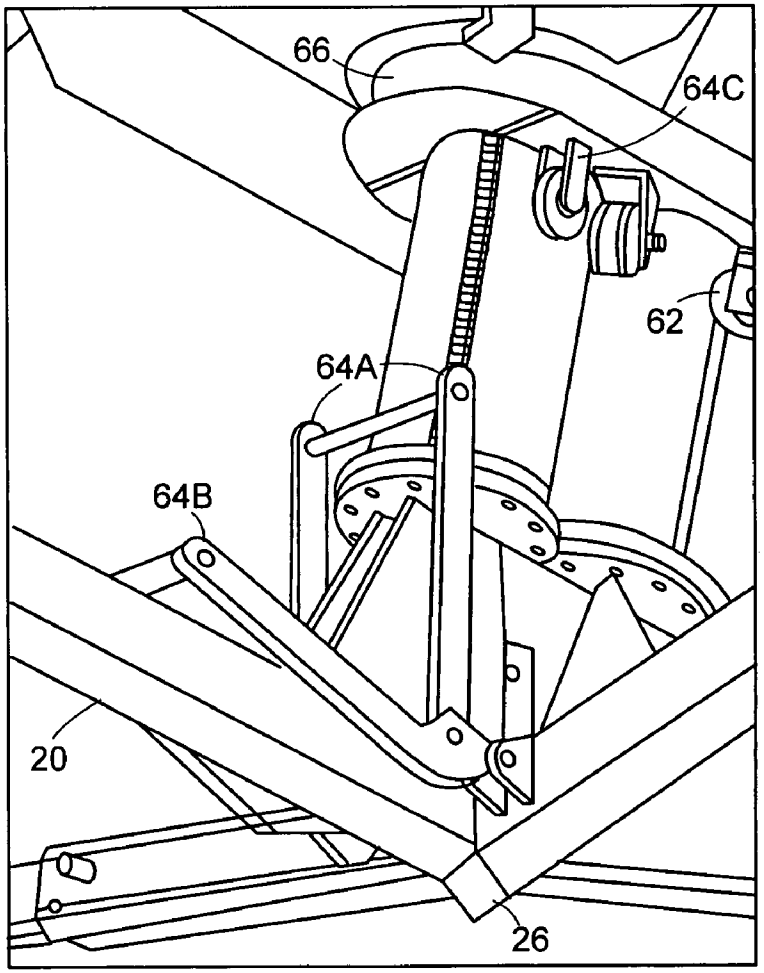
FIGS. 3B-C are pictorial views of the launcher latch mechanism.
Figure 3B:
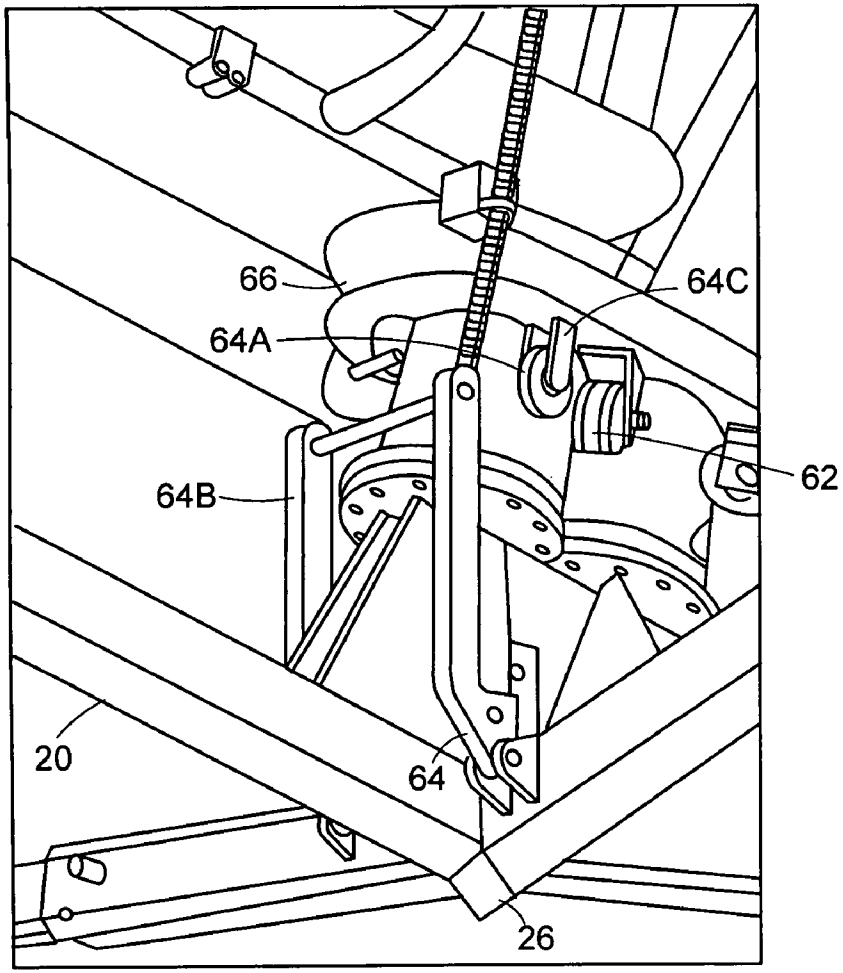

In a specific embodiment, the base of the carriage 60 has at least a securing hook 64C as part of a latch mechanism 64 that restrains the carriage prior to launch. FIGS. 3B-C depict an embodiment of the latch mechanism 64 that restrains and releases the carriage 60. FIG. 3B shows the latch mechanism 64 restraining the carriage 60 in a resting position. FIG. 3C shows the latch mechanism 64 releasing the carriage 60 to a launch position. The latch mechanism 64 may be located on any part of the launcher. Preferably, the latch mechanism 64 is on the base 20 to minimize the weight of the carriage 60.

Still referring to FIGS. 3B-C, the latch mechanism 64 includes a securing device 64A and a releasing mechanism 64B. In this embodiment, at least one securing device 64A holds the bottom end of the carriage 60 in a resting position. The securing devices may be hooks, clamps, clips, or other similar devices to hold a carriage in place. Furthermore, the securing devices may be attached to a releasing mechanism, such that, when the releasing mechanism is triggered, the securing devices release the carriage. The releasing mechanism could be a button that the user pushes, a handle that the user pulls down, a lever that is switched, or any other types of mechanisms, such as electromagnetic devices, that can release a securing device.

Energy Source

At least one energy source provides the energy to propel the carriage and launch the payload. The potential energy is subsequently transformed to kinetic energy to propel the carriage. Different types of energy sources may be used. Energy sources such as a pneumatic system, spring-loaded system, elastic cords, hydraulic fluid or electromagnetic, may be used. Furthermore, combination of energy sources may also be used. In one embodiment as shown in FIG. 1, the preferred energy source 80 is a pneumatic system with compressed air. Compressed air, which is readily available provides an easily transportable and portable means of storage. In this embodiment, the compressed air 80 is stored in a reservoir 88. The gas in a compressed air reservoir 88 is compressible to a desired pressure. The reservoir 88 may include a pressure gauge 81 to monitor and/or display the pressure. A subsequent pressure monitor may be located on a launch control panel. Structurally, the reservoir 88 is preferably coupled to the base 20 of the launcher. In this configuration, a pneumatic feed tube 48 fluidly couples the reservior 88 to the rodless pneumatic cylinder 41. Alternatively, the energy source reservoir may be coupled to other parts of the launcher.

Operating Mechanism of the Launcher

Figure 4A:
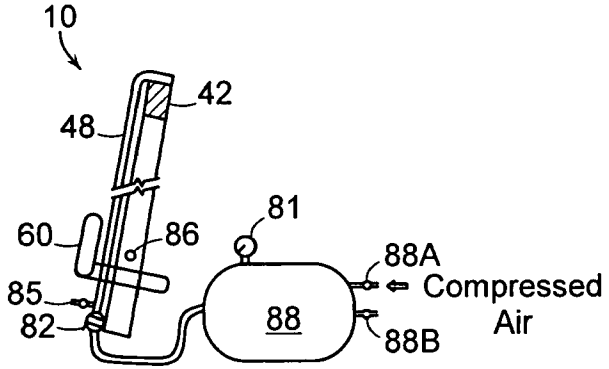
FIGS. 4A-E are schematics of the launcher from setup through launch.
Figure 4B:
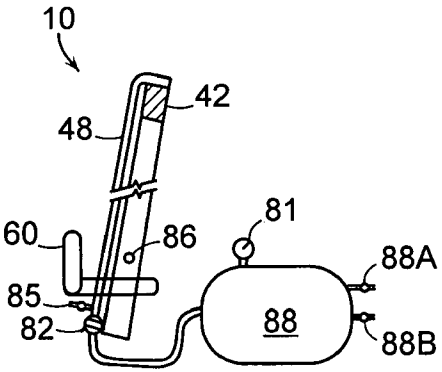
Figure 4C:
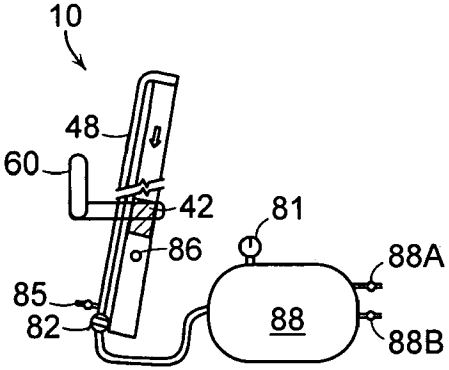

Operationally, the controllable launcher can propel a payload through a predictable and repeatable trajectory to a desired height and distance. FIGS. 4A-E show schematics of a specific embodiment of the launcher 10 with compressed air as the energy source. In FIG. 4A, the reservior 88 is pressurized through the reservior inlet valve 88A. Excess pressure may be vented through reservior vent valve 88B. While pressurizing the reservoir 88, the launch valve 82 and feed tube vent valve 85 are closed. Initially, the piston 42 is in the up position as shown in FIGS. 4A and B. Based on the counterbalancing system, the carriage 60 is accordingly in the down or resting position and may be restrained by the latch mechanism 64. Releasing the latch mechanism triggers a cascade of pneumatic events that launch the payload. Just before releasing the latch to initiate launch as shown in FIG. 4B, the launch valve 82 is opened to preload the piston. Opening the launch valve 82 forces the pressurized air into the cylinder 41 via the pnematic feed tube 48. The pressurized air drives the piston 42 to the bottom of the rodless cylinder 41. Based on the closed loop connection and the piston-carriage counterbalancing system, a movement of the piston drives the carriage in an opposite direction. In this instance, the downward movement of the piston 42 propels the carriage 60 in the upward position. Accordingly, the payload is propelled and launched at the set trajectory. FIG. 4C shows that while the piston 42 is plummeting towards the bottom of the cylinder, the low-pressure air in the cylinder 41 is vented through the cylinder vent 86.

In another embodiment of the invention which may not include a latch mechanism, the launching process is controlled by actively modulating the launch valve 82. In this embodiment, the the energy source may be variable or fixed. In an embodiment with compressed air, the reservior may be set at a fixed pressure and the user can control the the launch by regulating the launch valve 82. The carriage accelerations may also be controlled by the active modulation of the launch valve 82 in an embodiment where the air pressure is varied or fixed.

Figure 4D:
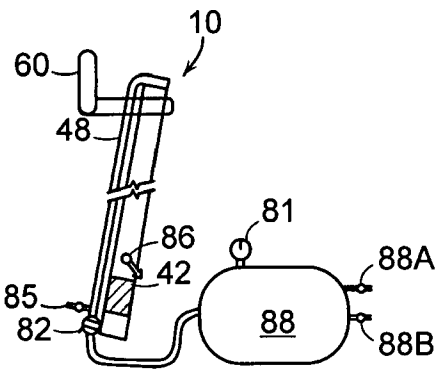

After launching the payload, the launcher triggers a mechanism to shut off the supply of energy. In this embodiment, the shut off mechanism includes the shut off lever 82B and a cable 82A connecting the lever to the launch valve 82. As shown in FIG. 4D, when the carriage 60 reaches the top of the guide rail 41A, it activates the shut off lever 82B to close the launch valve 82. In another embodiment, the carriage may activate a switch when it reaches the top end of the guide rail 41A. The switch could be a lever, sensor, electronic switch, button, or any similar switch. In addition, the switch could be triggered manually, by the carriage, or by an automatic timer.

In the embodiment of FIG. 1, the switch is a lever 82B connected to the launch valve 82 via a valve cable 82A. The carriage 60 can trigger the lever 82B to close the launch valve 82. Operationally, when the carriage 60 travels up the guide rail 41A, it triggers the lever 82B, which causes the valve cable 82A to move the valve arm 82C and thus close the launch valve 82.

Turning back to the operating mechanism of the launcher shown in FIG. 4D, while the carriage 60 prepares to trigger the shut off lever 82B, the piston 42 would be plummeting down the cylinder 41. As the piston 42 passes the cylinder vent 86 during its plummet, the vent can now expel the piston-driving high-pressure gas following it. Preferably, the cylinder vent 86 is near the bottom of the cylinder 41 such that when the piston 42 travels downward, low-pressure gas is pushed out the vent 86 and once the piston 42 passes, high-pressure gas is rapidly released through the vent 86. Still referring to FIG. 4D, the feed tube vent valve 85 may also be activated to expel the pressurized air present in the cylinder 41 and feed tube 48.

Figure 4E:
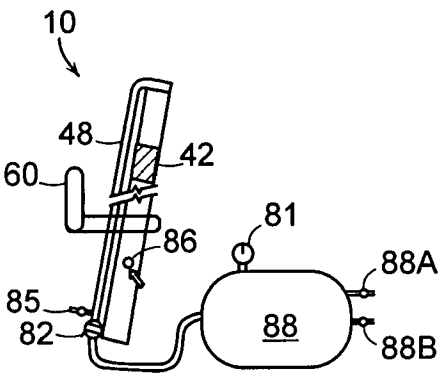

To return the carriage 60 to the prelaunch position and thus prepare for another launch, the cylinder vent 86 and feed tube vent valve 85 may still be open, as shown in FIG. 4E, to completely vent the cylinder 41 and feed tube 48. In other words, opening the feed tube vent valve 85 and the cylinder vent 86 allows the carriage 60 and piston 42 to be returned to the prelaunch position without a buildup of pressure within the cylinder 41. Thereinafter, the feed tube vent valve 85 is closed to repeat the sequence for another launch.

The launcher includes a deceleration mechanism to minimize the movement of the launcher during the launch. The deceleration mechanism decelerates the carriage as the carriage reaches its peak velocity. The deceleration mechanism also helps to keep the launcher statically stable. Referring back to FIG. 1, the deceleration system 65 is activated when the carriage 60 reaches the top of the guide rail 41A. The deceleration system 65 comprises, a carriage arresting bracket 652, stopper 654, at least a decelerating cable 656, and spring retaining cylinder 658 with a least a spring 655. Preferably, the carriage arresting bracket 652 is coupled to the carriage 60 and the spring retaining cylinder 658 contains a stack of disk springs. In one embodiment, the carriage arresting bracket 652 is mounted to the top of the carriage 60. The stopper 654 is located near the top of the guide rail 41A. The stopper 654 may be a shock absorbing material. As shown in FIG. 1, the stopper 654 is connected by the deceleration cables 656 to a stack of springs 655 in the spring retaining cylinder 658. The spring retaining cylinder 658 is rigidly coupled to the base 20. A method of operating the deceleration system 65 begins when the carriage 60 reaches the top end of the guide rail and the payload is launched. In an embodiment, a carriage arresting bracket 652 (shown in FIG. 3A) on the top end of the carriage 60 slams into the stopper 654. The impact of the carriage 60 may move the stopper 654. Any movement of the stopper 654 will pull upward on the spring stack 655 in the spring retaining cylinder 658. Accordingly, a stronger carriage impact may compress more springs in the spring retaining cylinder to stop any further movement of the carriage.

A decelerating device 44 is also present at the base of the rodless cylinder 41 to absorb the energy of the piston 42. Referring back to the initial launch process as shown in FIG. 4B, as the piston 42 propels downward, the piston is stopped when it contacts a shock absorbing material 442 (not shown) at the bottom of the cylinder. In one embodiment, the shock absorbing material is a stack of spring washers. The shock absorbing material could be a spring or material with shock absorbing properties.

In accordance with an embodiment of the present invention, the decelerating devices may be any device or material that may absorb energy. Examples of such energy absorbing material may be a fluid or electromagnetic damper. Furthermore, during the deceleration operation, the forces from the carriage and piston deceleration are substantially equal but in opposite directions due to the counterbalancing property of the components. Accordingly, these substantially equal but opposite forces substantially cancel each other out and thus minimize excessive movements of the launcher throughout the launch and deceleration process.

Figure 5:
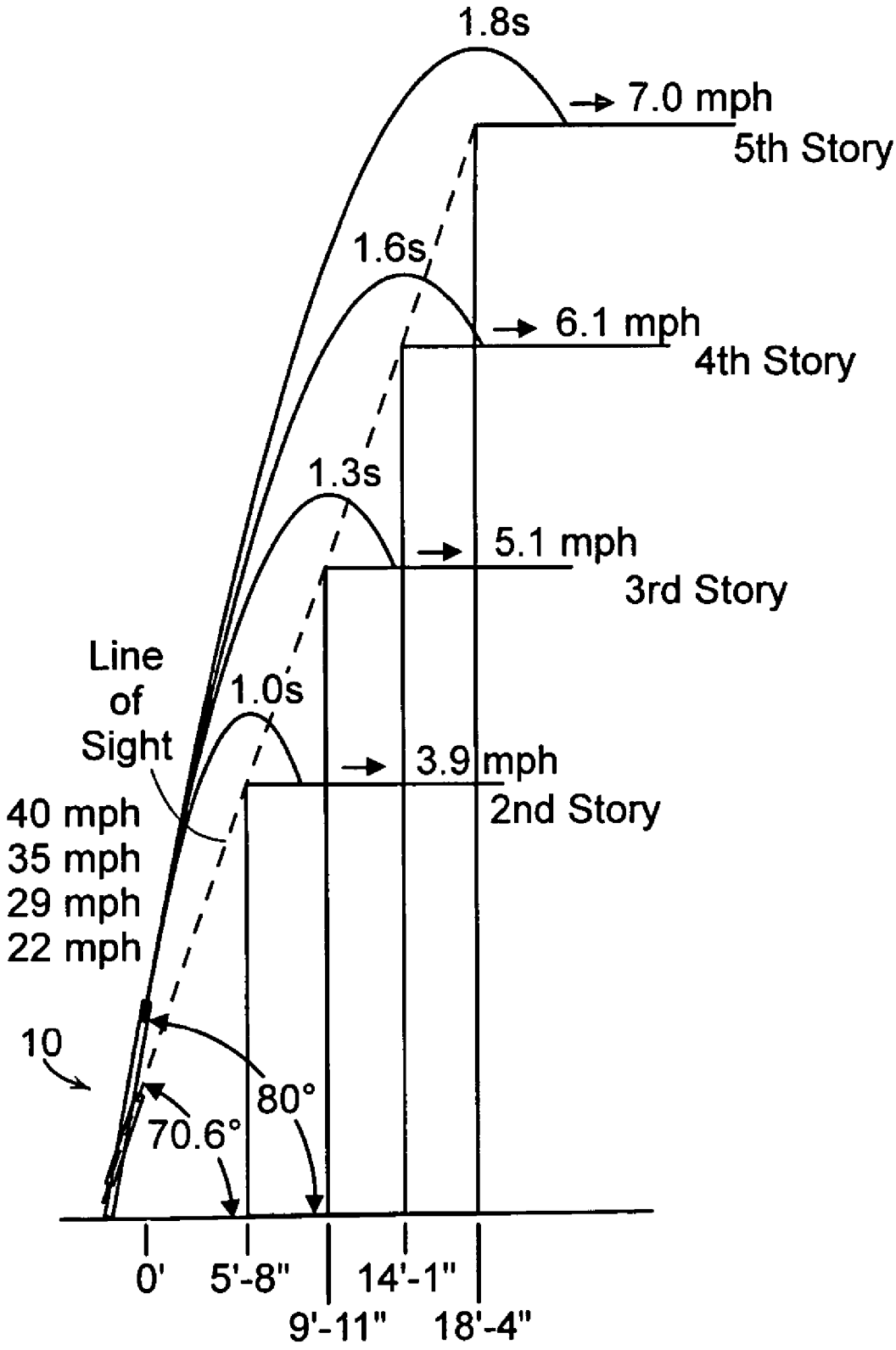
FIG. 5 shows the varying heights and speeds that a payload may travel when the launcher is angled to about 80 degrees and the corresponding distance from the structure.

Referring now to FIGS. 1 and 5, a method of using the launcher 10, to launch a payload 66 to a specified height, comprises: aligning the launcher; calculating the energy required for the launch; and launching the payload. In an embodiment with a latch mechanism, the step of launching the payload may further comprise latching and releasing the carriage.

The first step of aligning the launcher 10 may further comprise: aligning the launcher with the leading edge of the destination structure; calculating the horizontal distance of the launcher from the destination structure and calculating the required energy for the launch. After leveling the base of the launcher, a user aligns the guide rail with a leading edge of the destination structure to ensure that the payload will land a safe impact distance from the edge of the structure. The preferred 80-degree launch angle optimizes the safe impact distance from the edge of the destination structure while minimizing the horizontal velocity at impact. In a working example as shown in FIG. 6, a launcher may be fixed at a preferred angle to ensure the payload lands at a safe distance from the edge of the structure.

A calculation of the horizontal distance from the destination structure may help determine the launch parameters. When the platform is properly leveled, the horizontal distance from the building to the launch platform with respect to the vertical height of the building is a fixed ratio. Therefore, the energy required to launch the payload is be calculated based on the payload mass and the height of the building determined by the trigonometric relationship (shown in FIG. 6) of the horizontal distance between the device and the building. Next, the user determines the energy required for the launch. To vary the height of the trajectory, the user may vary the amount of energy used to propel the carriage.

The device will launch the payload on trajectories as shown in the example of FIG. 5. In this example, the preferred angle is fixed at 80 degrees. However, the angle of the guide rail could be varied. In the preferred embodiment, the set angle ensures there is sufficient horizontal travel to place the payload a safe distance from the edge of the roof, while keeping the horizontal velocity at impact at a manageable level.

The step of aligning the launcher may be performed manually or automatically. When done manually, a user performs the initial tasks and sets the launcher to the specified positions. In an embodiment with automatic alignment capabilities, a user may simply input a variable in a control panel as described infra and the processor can calculate the launch parameters based on the measured parameters. Some of the automatic alignment devices may include a rangefinder to determine the height of the destination structure and the distance of the launcher from the destination structure.

Turning back to the working example in FIG. 6, where the alignment scope of the launcher is fixed at 80 degrees, the alignment scope is used to sight the leading edge of the building above which the payload is to be launched. The launcher is moved horizontally until the edge of the building comes into view using the alignment scope. When the platform is properly leveled, the horizontal distance from the building to the launch platform with respect to the vertical height of the building is a fixed ratio. Thus, the energy required to launch the payload is calculated based on the payload mass and the height of the building determined by the horizontal distance between the device and the building.

After aligning the launcher, a user may, for safety reasons, restrain the carriage before beginning the next step of calculating the energy required for the launch. In a specific embodiment with a mechanical latch, the latch restrains the carriage in down position as shown in FIG. 1. The payload may now be loaded. After restraining the carriage, the energy source may now be prepared for launch. In an embodiment with compressed gas 80 as the energy source, the gas may now be compressed to the required pressure for the desired height. Preferably, the above steps of aligning the launcher and latching the carriage are performed sequentially or simultaneously. However, the steps could be performed in any order.

The next step is to launch the payload. To start launch sequence, the launch valve 82 is opened and pressure is applied to the piston 42. The user may then release the latch mechanism. Based on the mechanics of the launcher in this embodiment, releasing the latch mechanism triggers a cascade of events described below which eventually launch the payload. When the carriage is latched in the down position, the piston is in the up position. As the latch mechanism is released, the pressurized air drives the piston to the base of the rodless cylinder. Based on the closed loop connection and counterbalancing system of the piston and the carriage, a movement of the piston drives the carriage in an opposite direction. In this instance, the downward movement of the piston propels the carriage in the upward position. Accordingly, the payload is propelled and launched at the predictable trajectory. Turning back to the example in FIG. 5, based on the predictable and controllable trajectory of the launched payload, several vertical feet of over travel will ensure that the payload can safely clear the edge of the building. Furthermore, this trajectory also allows the device to be used between buildings in an alley. In this example, the total flight time will be less than 2 seconds to reach the top of a 5-story building.

Automated Launcher

In one embodiment of the invention, the operation of the launcher is automated. In this embodiment, the steps of aligning the launcher and latching the carriage may be automated. In a specific embodiment, the launcher may be automatically aligned by the automated levelling mechanisms. Here, a user provides an input and alignment devices, such as rangerfinders can measure the vertical and horizonal distances to the destination structure. Next, the processor may calculate the required energy for a launch. In this embodiment, a user simply loads the payload and the launch process is automated. To automate the launch process, a load cell on the carriage may determine the weight of the payload. Using feedback control systems the launcher may determine the required energy to launch the payload to the desired trajectory.

Other embodiment of the automated launcher may have automated valve control mechanism. In such embodiments, the launcher may not include a latch mechanism. Here, the launcher control systems may control the energy or piston velocity through the modulation of the valves. In one specific embodiment, the launcher may have a fixed energy, such as at a fixed pressure, and the launcher control system can control the air pressure in the rodless cylinder 40A, piston velocity, and/or the carriage accelerations based on active modulation of the launch valve 82.

In another embodiment of the launcher, the carriage may include a device to further propel the payload during the launch. In certain embodiments, the device may be a charged cylinder, bellow or spring, that may further propel the payload base on the principle of the conservation of momentum. In a specific embodiment, the supplemental payload propelling device is a charged cylinder coupled to the seat of the carriage but underneath the payload. During operation, the charged cylinder propulsion mechanism is cocked during the launch. The charged cylinder may be fired during or near the end of the launch. On activating the supplemental payload propelling device, the device imparts additional energy to the payload. Furthermore, the supplemental payload propelling device may be used to decelerate the carriage after launch. In this deceleration application, the device may impart an equal and opposite force to decelerate the carriage. In such an embodiment where the supplemental payload propelling device may produce a deceleration force, the launcher may not include certain components of the deceleration mechanisms, such as the deceleration springs, described earlier. Other specific embodiments, may include the supplemental payload propelling device that can impart a precise deceleration force to decelerate the carriage to zero velocity, such that, the launcher may potentially not require the carriage and piston deceleration springs.

Additionally, the launcher may have a launch control panel to control the launch process. This launch control panel may have all the gauges and devices, such as an alignment scope and distance calculator, to enable a user to set the launcher. In this embodiment, preferably, the control panel is coupled to the launcher. Alternatively, the control panel may be connected to the launcher by hard wire or telemetry. A remotely controllable launcher faciltates control from a distance. Thus, this feature broadens the types of payloads that may be launched.

Other embodiments of the launcher may be mobile. In a mobile launcher embodiment, the base may have other components to facilitate movement. The components could be devices such as wheels or tracks, that enable the launcher to be easily moved. In a mobile launcher embodiment, the guide rail assembly could be collapsible to make the launcher portable, mobile and easily transportable. Additionally, the energy source reservior may be located in another area (eg. in the transporter) but fluidly connected to the launcher. Furthermore, each component of the launcher may be optimized for minimum weight and maximum strength.

In view of the foregoing, it will be understood that the scope of the invention as defined in the following claims is not limited to the embodiments described herein, and that the above and numerous additional variations and modifications could be made thereto without departing from the scope of the invention.

What is claimed is:

1. A controllable launcher for launching human payloads to a desired height comprising:

a base;

a guide rail assembly coupled to the base;

a carriage for carrying a human payload along the guide rail, the carriage comprising a seat attached to a back support wherein the carriage is configured such that a human payload may sit in an upright position;

a counterbalancing system attached to the carriage, wherein the counterbalancing system includes a first cable and a second cable;

an energy source for propelling the carriage to a specified position based upon a calculation of a desired trajectory of the human payload; and an alignment device for aligning the launcher so as to achieve the desired trajectory of the payload wherein the alignment device includes an alignment scope.

2. The controllable launcher of claim 1, further comprising a latch mechanism for securing said carriage prior to launch.

3. The controllable launcher of claim 1, further comprising a control mechanism to modulate the amount of energy from the energy source applied to propel the carriage.

4. The controllable device of claim 1, wherein the alignment device includes a distance measure to measure the horizontal distance between the base of the launcher and the desired trajectory of the payload.

5. The controllable launcher of claim 1, further comprising a calculator to compute an amount of energy needed to propel the payload to the desired trajectory.

6. The controllable launcher of claims 1, wherein the energy source includes a member selected from the group consisting of pneumatic system, spring-loaded system, elastic-corded system, hydraulic-fluid system, and electromagnetic system.

7. The controllable launcher of claim 1, further comprising a leveling system coupled to said base.

8. The controllable launcher of claim 1, wherein said energy source is a pneumatic system comprising:

compressed gas;

an air pressure reservoir that holds said compressed gas; and a pneumatic feed tube that transports said compressed gas from said air pressure reservoir to said hollow guide rail, where said compressed gas exerts force on said piston.

9. The controllable launcher of claim 8, further comprising a valve coupled to said pneumatic feed tube for stopping the flow of compressed gas from said reservoir to said pneumatic feed tube.

10. The controllable launcher of claim 9, further comprising a switch for activating said valve.

11. The controllable launcher of claim 10, wherein said switch is a mechanical lever secured to said top end of said hollow guide rail and wherein said switch is triggered when said carriage contacts said mechanical lever.

12. A controllable launcher for launching human payloads to a desired height comprising:

a base;

a guide rail assembly coupled to the base;

a carriage for carrying a human payload along the guide rail, the carriage comprising a seat attached to a back support wherein the carriage is configured such that a human payload may sit in an upright position;

a deceleration mechanism coupled to the carriage and the base wherein the deceleration mechanism comprising at least one spring;

an energy source for propelling the carriage to a specified position based upon a calculation of a desired trajectory of the human payload; and an alignment device for aligning the launcher so as to achieve the desire trajectory of the payload wherein the alignment device includes an alignment scope.

13. The controllable launcher of claim 12, further comprising a calculator to compute an amount of energy needed to propel the payload to the desired trajectory.

14. The controllable launcher of claim 12, further comprising a leveling system coupled to said base.

15. The controllable launcher of claim 12, further comprising an alignment device for aligning the launcher so as to achieve the desired trajectory of the payload.

16. The controllable device of claim 12, wherein the alignment device includes a distance measure to measure the horizontal distance between the base of the launcher and the desired trajectory of the human payload.

* * * * *